US007164227B2

(12) United States Patent
de Grys

(10) Patent No.: US 7,164,227 B2
(45) Date of Patent: Jan. 16, 2007

(54) HALL EFFECT THRUSTER WITH ANODE HAVING MAGNETIC FIELD BARRIER

(75) Inventor: Kristi H. de Grys, Bothell, WA (US)

(73) Assignee: Aerojet-General Corporation, Redmond, WA (US)

( * ) Notice: Subject to any disclaimer, the term of this patent is extended or adjusted under 35 U.S.C. 154(b) by 0 days.

(21) Appl. No.: 11/233,401

(22) Filed: Sep. 21, 2005

(65) Prior Publication Data

US 2006/0076872 A1 Apr. 13, 2006

Related U.S. Application Data

(63) Continuation of application No. 10/241,820, filed on Sep. 10, 2002, now Pat. No. 6,982,520.

(60) Provisional application No. 60/322,560, filed on Sep. 10, 2001.

(51) Int. Cl.
*H05H 5/03* (2006.01)

(52) U.S. Cl. ..... 313/361.1; 313/359.1; 313/362.1; 313/231.31

(58) Field of Classification Search ..... 313/359.1, 313/361.1, 362.1, 231.31; 315/111.41, 111.61
See application file for complete search history.

(56) References Cited

U.S. PATENT DOCUMENTS 5,359,258 A 10/1994 Arkhipov et al.
5,763,989 A 6/1998 Kaufman
5,798,602 A 8/1998 Gopanchuk et al.
5,838,120 A 11/1998 Semenkin et al.
5,892,329 A 4/1999 Arkhipov et al.
6,075,321 A 6/2000 Hruby
6,208,080 B1 3/2001 King et al.
6,456,011 B1 9/2002 Bugrova et al.

OTHER PUBLICATIONS

Gavryushin, V.M., and Kim, V., "Effect of the Characteristics of a Magnetic Field on the Parameters of an Ion Current at the Output of an Accelerator with Closed Electron Drift," *American Institute of Physics*, pp. 505-507 (Apr. 1981).
Kaufman, H.R., "Technology of Closed-Drift Thrusters," *AIAA Journal 23*(1):78-87, 1995.
Morozov, A.I., et al., "Plasma Accelerator with Closed Electron Drift and Extended Acceleration Zone," *Soviet Physics-Technical Physics 17*(1):38-45, Jul. 1972.
Morozov, A.I., et al., "Effect of the Magnetic Field on a Closed-Electron-Drift Accelerator," *Soviet Physics-Technical Physics 17*(3):482-487, Sep. 1972.

*Primary Examiner*—Nimeshkumar D. Patel
*Assistant Examiner*—Matt Hodges
(74) *Attorney, Agent, or Firm*—Christensen O'Connor Johnson Kindness PLLC

(57) ABSTRACT

An efficiency enhancing anode-magnetic structure of a Hall effect thruster produces a radially directed magnetic field between inner and outer poles at the exit portion of a gas distribution channel. The field-shaping structure includes magnetic material extending alongside the channel with an associated secondary flux-generating component to create an axially directed magnetic field in the area between the anode of the thruster and the exit portion of the gas distribution channel.

10 Claims, 6 Drawing Sheets

HALL EFFECT THRUSTER WITH ANODE HAVING MAGNETIC FIELD BARRIER

CROSS-REFERENCE TO RELATED APPLICATIONS

This application is a continuation of application No. 10/241,820, filed Sep. 10, 2002, now U.S. Pat. No. 6,982,520, which claims the benefit of U.S. Provisional Patent Application No. 60/322,560, filed Sep. 10, 2001.

FIELD OF THE INVENTION

The present invention relates to a system for shaping the magnetic field in an ion accelerator with closed drift of electrons, i.e., a system for controlling the contour of the magnetic field lines in a direction longitudinally of the gas discharge region of the accelerator, particularly in the area leading or adjacent to the anode, upstream from the ion exit end.

BACKGROUND OF THE INVENTION

Ion accelerators with closed electron drift, also known as "Hall effect thrusters" (HETs), have been used as a source of directed ions for plasma assisted manufacturing and for spacecraft propulsion. Representative space applications are: (1) orbit changes of spacecraft from one altitude or inclination to another; (2) atmospheric drag compensation; and (3) "stationkeeping" where propulsion is used to counteract the natural drift of orbital position due to effects such as solar wind and the passage of the moon. HETs generate thrust by supplying a propellant gas to an annular gas discharge channel. Such channel has a closed end which includes an anode and an open end through which the gas is discharged. Free electrons are introduced into the area of the exit end from a cathode. The electrons are induced to drift circumferentially in the annular exit area by a generally radially extending magnetic field in combination with a longitudinal electric field, but electrons eventually migrate toward the anode. The electrons collide with the propellant gas atoms, creating ions which are accelerated outward due to the longitudinal electric field. Reaction force is thereby generated to propel the spacecraft.

It has long been known that the longitudinal gradient of magnetic flux strength has an important influence on operational parameters of HETs, such as the presence or absence of turbulent oscillations, interactions between the ion stream and walls of the thruster, beam focusing and/or divergence, and so on. Such effects have been studied for a long time. See, for example, Morozov et al., "Plasma Accelerator With Closed Electron Drift and Extended Acceleration Zone," *Soviet Physics-Technical Physics*, Vol. 17, No. 1, pages 38–45 (July 1972); and Morozov et al., "Effect of the Magnetic Field on a Closed-Electron-Drift Accelerator," *Soviet Physics-Technical Physics*, Vol. 17, No. 3, pages 482–487 (September 1972). The work of Professor Morozov and his colleagues has been generally accepted as establishing the benefits of providing a radial magnetic field with increasing strength from the anode toward the exit end of the accelerator. For example, H. R. Kaufman in his article "Technology of Closed-Drift Thrusters," *AIAA Journal*, Vol. 23, No. 1, pages 78–87 (July 1983), characterizes the work of Morozov et al. as follows:

The efficiency of a long acceleration channel thus is improved by concentrating more of the total magnetic field near the exhaust plane, in effect making the channel shorter.

Another interpretation, perhaps equivalent, is that ions produced in the upstream portion of a long channel have little chance of escape without striking the channel walls. Concentration of the magnetic field at the upstream end of the channel therefore should be expected to concentrate ion production further upstream, thereby decreasing the electrical efficiency.

Id. at 82–83. For experimental purposes, Morozov et al. achieved different profiles for the radial magnetic field at the exit end by controlling the current to coils of separate electromagnets. For a given magnetic source (electromagnet or permanent magnets), other ways to affect the profile of the magnetic field are configuring the physical parameters of magnetic-permeable elements in the magnetic path (such as positioning and concentrating magnetic-permeable elements at the exit end of the accelerator), and by magnetic "screening" or shunts which can be interposed between the source (s) of the magnetic field and areas where less field strength was considered desirable, such as near the anode. For example, in their paper titled "Effect of the Characteristics of a Magnetic Field on the Parameters of an Ion Current at the Output of an Accelerator with Closed Electron Drift," *Sov. Phys. Tech. Phys.*, Vol. 26, No. 4 (April 1981), Gavryushin and Kim describe altering the longitudinal gradient of the magnetic field intensity by varying the degree of screening of the accelerator channel. Their conclusion was that magnetic field characteristics in the accelerator channel have a significant impact on the divergence of the ion plasma stream.

In addition to the traditional structure of a Hall effect thruster disclosed in the publications referred to above, there have been more recent attempts to increase thruster efficiency and life by providing systems with modified magnetic fields at the exit end of the thruster. One example is the device shown in Arkhipov et al. U.S. Pat. No. 5,359,258, which provides radially inner and outer sources of magnetic fields to produce the substantially radial field lines at the exit end, and an "internal magnetic screen" and "external magnetic screen" in combination with an anode retracted inward from the exit plane of the thruster to concentrate the magnetic field at the exit end and lessen the magnetic field adjacent to the anode. King et al. U.S. Pat. No. 6,208,080, discloses another magnetic field distribution at the exit end of an HET and a magnetic shunt system for achieving that distribution. In the King et al. design, the walls of the gas discharge-acceleration chamber can be electrically conductive and maintained at anode potential. Conductive anodes located close to the exit plane also have been proposed, such as in Gopanchuk et al. U.S. Pat. No. 5,798,602, and Semenkin et al. U.S. Pat. No. 5,838,120. Particularly where anodes have been located close to the exit plane, the adjacent part of the anode may be more or less concave, such as in the devices disclosed in the patents issued to Gopanchuk et al. and Semenkin et al., referred to above, and Arkhipov et al. U.S. Pat. No. 5,892,329.

SUMMARY OF THE INVENTION

The present invention provides an improved system for magnetic flux shaping in an ion accelerator with closed electron drift (Hall effect thruster or HET). The improved system comprises a novel anode-magnetic structure used to increase efficiency of the thruster. As in a typical closed electron drift plasma accelerator, the magnetic field in the channel exit region between the magnetic pole pieces is primarily radial. However, as one moves toward the upstream end of the discharge channel, there is an abrupt transition from a primarily radial magnetic field to an axially directed magnetic field. There are two primary drivers for the efficiency increase brought about by the magnetic field configuration discussed. The first is that it reduces the anode sheath voltage. Higher sheath voltages reduce the accelerating voltage and lead to increased heat deposition in the anode. The second mechanism for increased efficiency is reduced plasma oscillations due to better coupling of electrons to the anode. Plasma oscillations reduce propellant utilization efficiency and increase plume divergence which decrease performance. They also lead to higher electromagnetic emissions which are very undesirable for spacecraft integration. In another aspect of the invention, efficiency is increased by reducing the plume divergence. In disclosed embodiments of the invention, the magnetic field transition is generated and controlled by a magnetic shunt and/or additional magnetic field generating components.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
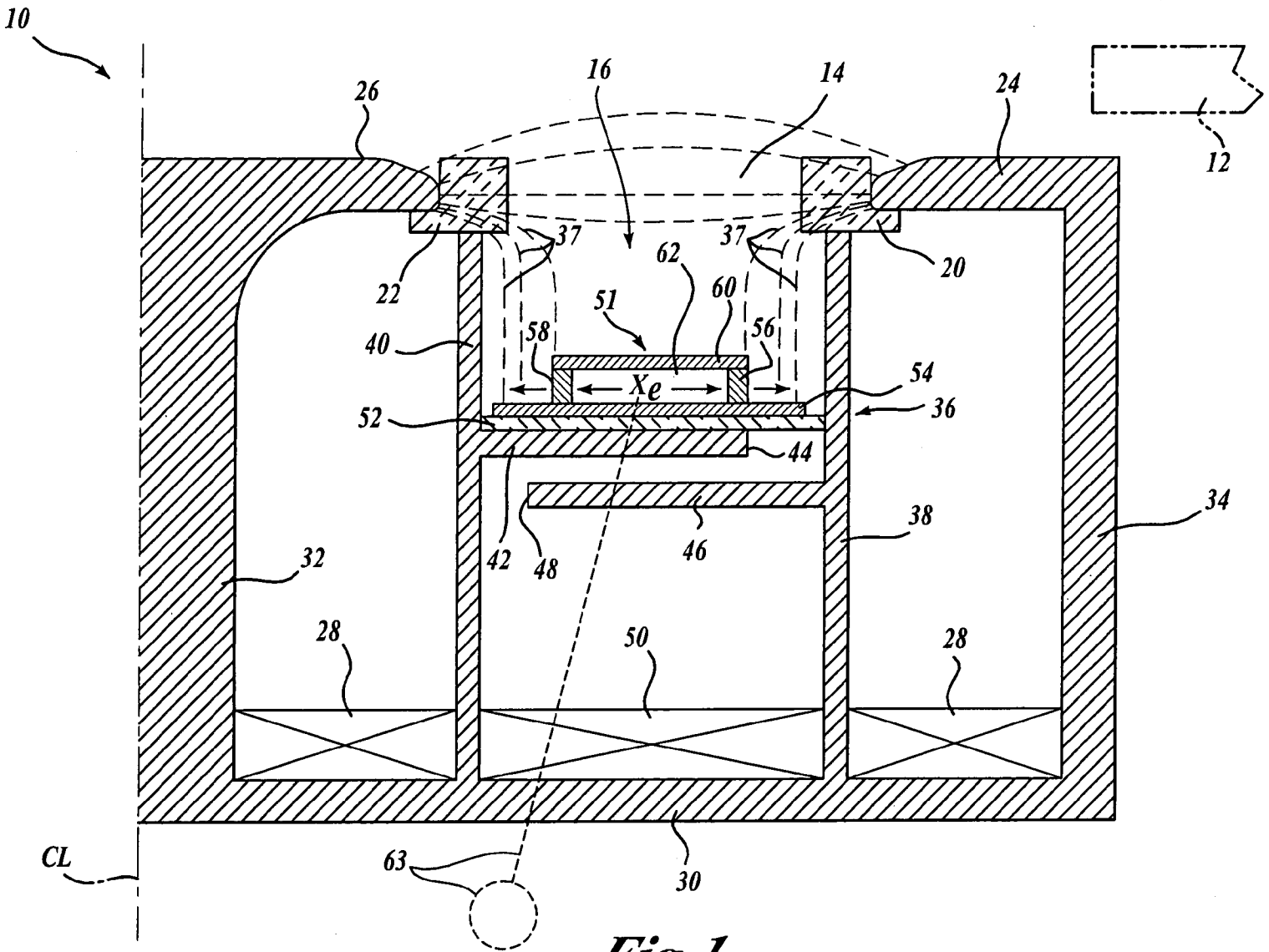
FIG. 1 is a diagrammatic radial section of one embodiment of an HET in accordance with the present invention.

FIG. 1 illustrates a representative Hall effect thruster (HET) 10 in accordance with the present invention, it being understood that the parts are shown diagrammatically and the dimensions exaggerated for ease of illustration and description. HET 10 has a magnetic structure which is a body of revolution about the centerline CL. In general, electrons are emitted by a cathode 12 for migration toward the exit end 14 of the annular discharge channel 16. The exit end 14 of the endless annular ion formation and discharge channel 16 is formed between an outer ceramic ring or insulator 20 and an inner ceramic ring or insulator 22. The ceramic preferably is electrically insulative, and sturdy, light, and erosion resistant. It is desirable to create an essentially radially-directed magnetic field in the exit area, between an outer ferromagnetic pole piece 24 and an inner ferromagnetic pole piece 26. In the illustrated embodiment, this is achieved by flux-generating coils 28, which may be variously located but which in the embodiment shown in FIG. 1 are located adjacent to the backplate 30 which, in combination with the central core 32 and outer wall 34, form a first or primary magnetic path between the outer and inner poles 24, 26. Stated in another way, the outer and inner poles 24, 26 are magnetically coupled by the central ferromagnetic core 32, backplate 30, and outer wall 34 to form the continuous magnetic path. In the absence of modifications in accordance with the present invention, the result of this construction is to concentrate magnetic flux in the exit end portion 14 of the annular discharge channel and to create a radially directed magnetic field in this area.

In accordance with the present invention, the accelerator is designed to induce substantially axially extending magnetic field lines (represented by broken lines 37) upstream of the annular exit area 14 where the magnetic field lines are essentially radial. In the embodiment of FIG. 1, this is achieved by a combined magnetic shunt 36 of generally H-shape, having an outer portion or shell 38 and an inner portion or shell 40 oriented in the axial direction. The shells define parallel magnetic segments which are magnetically coupled by the web of the "H" and the backplate 30. As shown in the drawings and described below, such web is located intermediate the upstream and downstream ends of the shells 38 and 40, and extends inward from shell 38 and outward from shell 36, close behind the anode (i.e., at the upstream side of the anode). Thus, a second or secondary magnetic path extends from close to the outer portion of the exit area 14 (adjacent to the innermost portion of the outer pole 24), rearward and across the discharge channel (behind the anode as described below), and then forward close to the inner portion of exit area 14 (adjacent to the outermost portion of the inner pole 26).

In the embodiment of FIG. 1, the web of the H-shaped shunt includes a long annular flange 42 of magnetic material that extends outward from the inner shell 40 with its outer end 44 close to, but spaced from, the outer shell 38, and a long annular flange 46 of magnetic material that extends inward from the outer shell 36 with its inner end 48 close to, but spaced from, the inner shell 40. The two flanges overlap and are closely spaced for magnetic coupling, but the respective magnetic materials are not in contact. A secondary flux coil 50 is located on the backplate between the inner 40 and outer shells 38. In other embodiments, the magnetic field source can be located anywhere effective to drive the secondary magnetic path. The axial field lines result from driving sufficient flux to saturate portions of the inner and outer shells 40, 38 in the region where the axial field lines are desired. Therefore, any embodiment where the secondary flux coil is located within a secondary magnetic circuit path which has a reluctance much less than that of the primary magnetic circuit composed of the inner and outer poles, central core, backplate, and outer wall can be designed to achieve a similar effect. The embodiment shown in FIG. 1 is advantageous because the secondary coil can be located near the rear of the thruster which facilitates cooler operating temperatures. It also eliminates the need for a second cross piece on the shunt by using the backplate to complete the secondary magnetic path. In this arrangement, the primary and secondary coils 28 and 50 can be fabricated as a single coil unit with gaps left in the winding for the locations where the inner and outer shells 40 and 38 connect to the backplate 30. Connecting the inner and outer shells to the backplate allows them to double as the primary structural supports for the anode region reducing the need for additional support structures which add additional mass and complexity to the design.

In FIG. 1, the inner and outer shunt shells 38, 40 do not function as the anode. In some applications, particularly in high power devices, the anode temperatures may exceed the Curie point of readily available magnetic materials. In these situations, it is advantageous to add separate non-magnetic anode shells which are only radiatively coupled to the magnetic shunt walls to reduce their operating temperature. Separate inner and outer anode shells which are also electrically insulated from the shunt are advantageous in situations where there is a desire to tie the inner and outer shunt shells directly to the backplate which must remain at ground potential. Creation of the axial magnetic field lines 38 in the upstream anode region can be enhanced by providing the secondary flux coil 50 adjacent to the backplate 30, between the outer and inner shells 38, 40.

The combined anode and component 51 for introducing ionizable gas into the anode region for flow toward the exit area 14 can be electrically and magnetically isolated from the magnetic shunt. In the embodiment of FIG. 1, an insulation gasket 52 extends between the outer and inner shells 38, 40 and supports the gas distribution component 51. Such component can include a backplate 54 supported on the gasket 52, porous metal rings 56 (outer) and 58 (inner), and an attached impervious front plate 60, all of which are maintained at anode potential. These components combine to provide an annular plenum 62 for the ionizable gas, such as xenon, which can be introduced by an external source (represented by broken lines 63). The gas flows generally radially outward and inward through the porous rings 56, 58 for flow toward the exit region 14. In this regard, reference is made to international patent publication No. WO 99/63222 of International Patent Application No. PCT/US99/12403, which discloses gas supply components to achieve uniform distribution of ionizable gas in an HET. At any rate, the particular gas distribution mechanism used in the present invention is not crucial. The invention resides in the provision of axially directed magnetic field lines in the area of the anode upstream from the exit region 14 but downstream from the gas discharge component 51 and, preferably, an abrupt transition from generally radially-directed magnetic field lines to axially-directed magnetic field lines.

The primarily axially-directed magnetic field in the region upstream of the discharge channel where gas is injected significantly alters the electron mobility in this region. Electrons are still tied to magnetic field lines as they are in the discharge channel and primarily axial field lines increase mobility in the axial direction. It is believed that the electron mobility in this region is the primary variable that influences the fall voltage in the anode sheath. For reduced electron mobility, the fall voltage must increase to maintain current continuity. Electron mobility is also believed to influence the plasma oscillations and instabilities characteristic of closed electron drift thrusters through a combination of current continuity and quasi-neutrality requirements. Oscillations and instabilities can lead to higher wall losses due to the acceleration of ions into the walls and lower ionization efficiency.

In the design of FIG. 1, the secondary coil 50 can be sized to generate about 5% to about 10% of the total flux generated by the primary coils 28. Other designs having one or more primary coils 28 and secondary coil 50 are shown in FIGS. 2A–2D. Each of these designs retains the generally H-shape of the magnetic shunt 36 which concentrates magnetic material of the secondary path behind the anode. The design of FIG. 2A differs from the design of FIG. 1 in that the primary coils 28 are positioned adjacent to the thruster core 32 and outer wall 34, with the outer and inner shunt-anode shells 38, 40 being connected at the rear by a separate magnetic and electrically conductive backplate 64 which is not magnetically coupled to the thruster backplate 30. The shunt 36 of FIG. 2A still has the overlapping flanges 42, 46, with the secondary coil 50 being positioned between a rear flange 46 and a separate backplate 64, spaced from the thruster backplate 30.

Figure 2A:
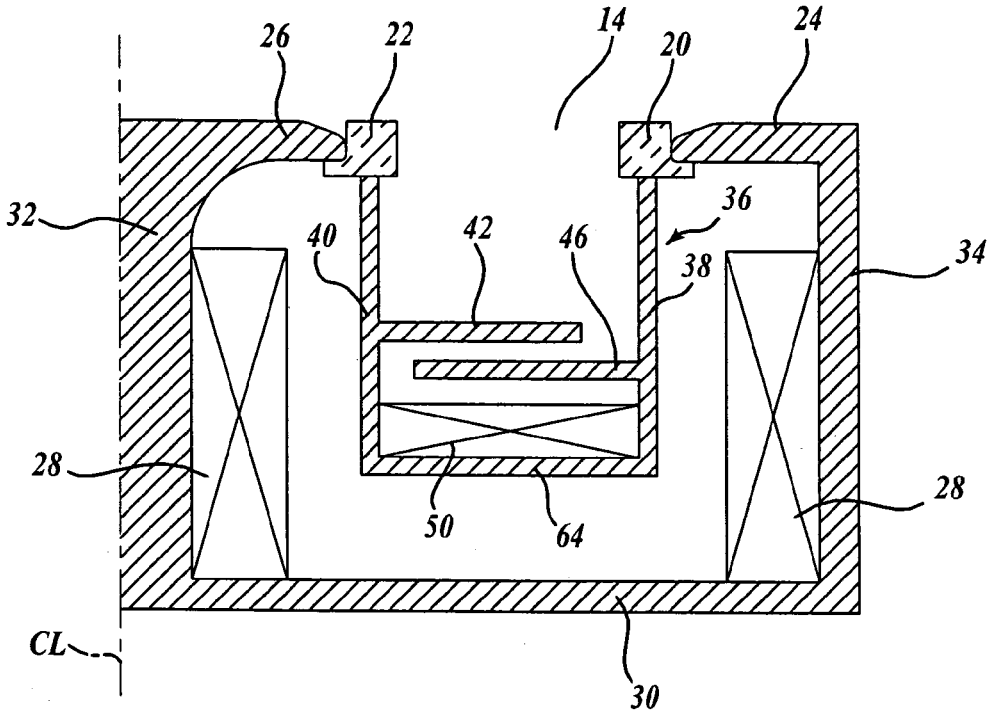
FIGS. 2A–2D are diagrammatic radial sections of additional embodiments of HETs in accordance with the present invention.
Figure 2B:
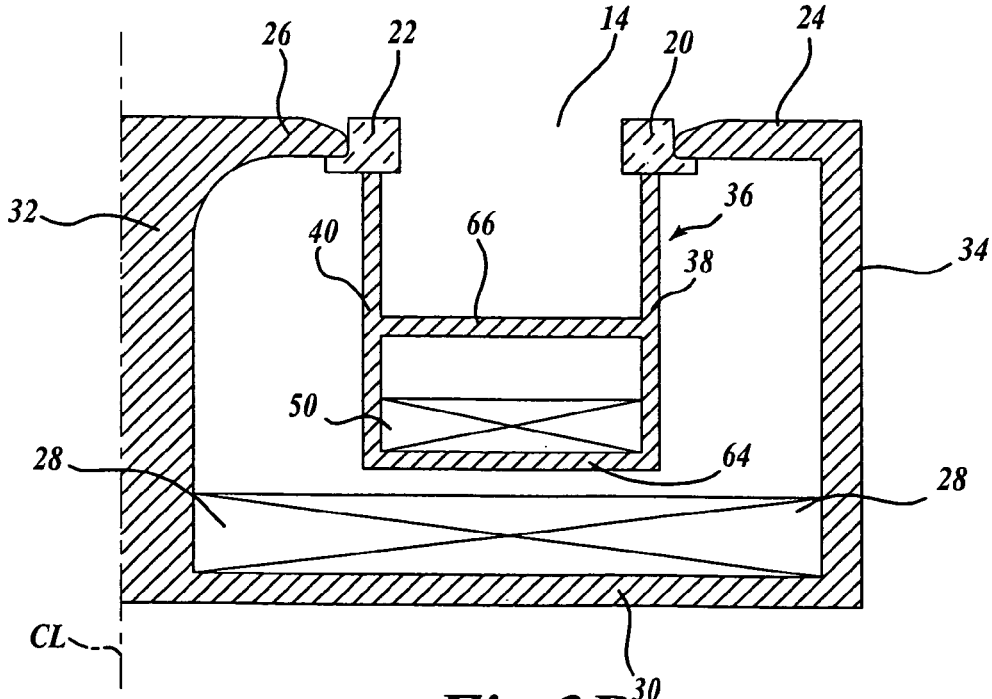

In the embodiment of FIG. 2B, the shunt 36 has a continuous intermediate annular plate or disk 66 (magnetic and electrically conductive) extending between the outer and inner shells 38, 40, and separate backplate 64 spaced from the thruster backplate 30. A single primary coil 28 is located adjacent to the thruster backplate 30, to the rear of the shunt-anode backplate 64.

Figure 2C:
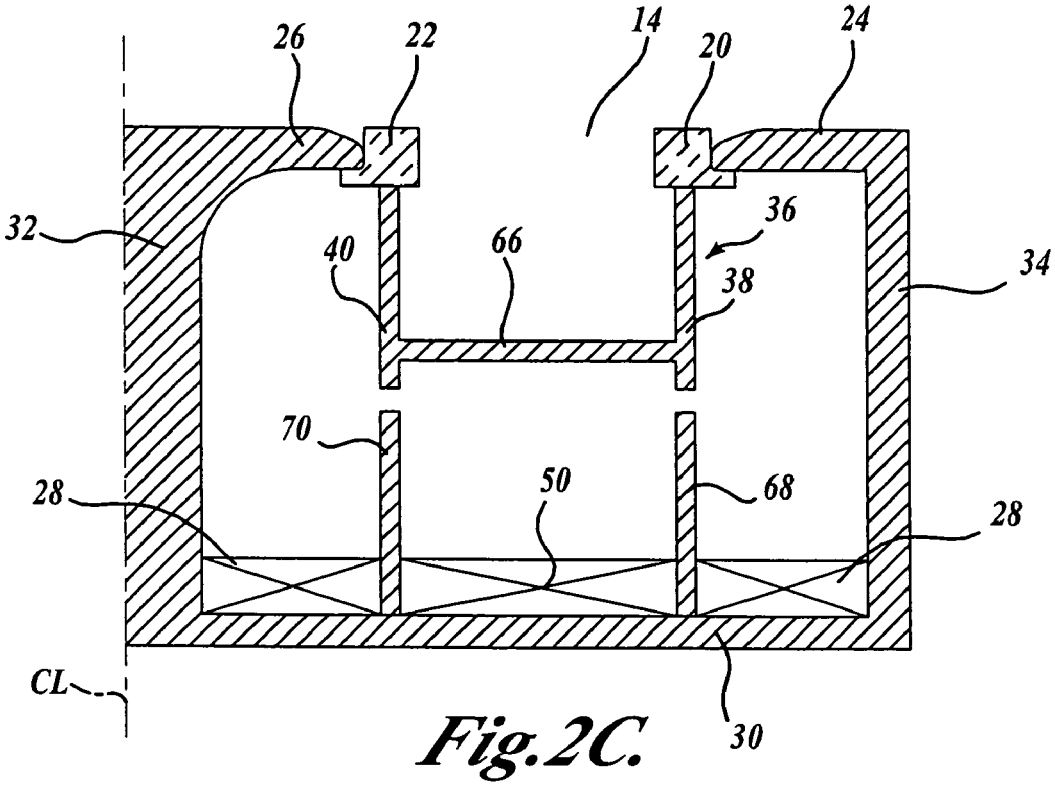

The orientation and positions of the primary coils 28 and secondary coil 50 of the design of FIG. 2C are essentially the same as for the design of FIG. 1. However, in the design of FIG. 2C, the outer and inner shunt-anode shells 38, 40 are not magnetically coupled to the thruster body, including stem rings 68 and 70 aligned with, but separated from, the shells 38, 40 which are supported at the position shown. In FIG. 2C, the decoupling of the inner and outer shunt-anode shells 38, 40 from the backplate is necessary in cases where the shunt doubles as the anode to allow the shunt to be electrically insulated from the backplate which must remain at ground potentially while the anode is biased to hundreds of volts. In all of the embodiments of FIGS. 2A–2C the shells 38 and 40 can be at anode potential.

Figure 2D:
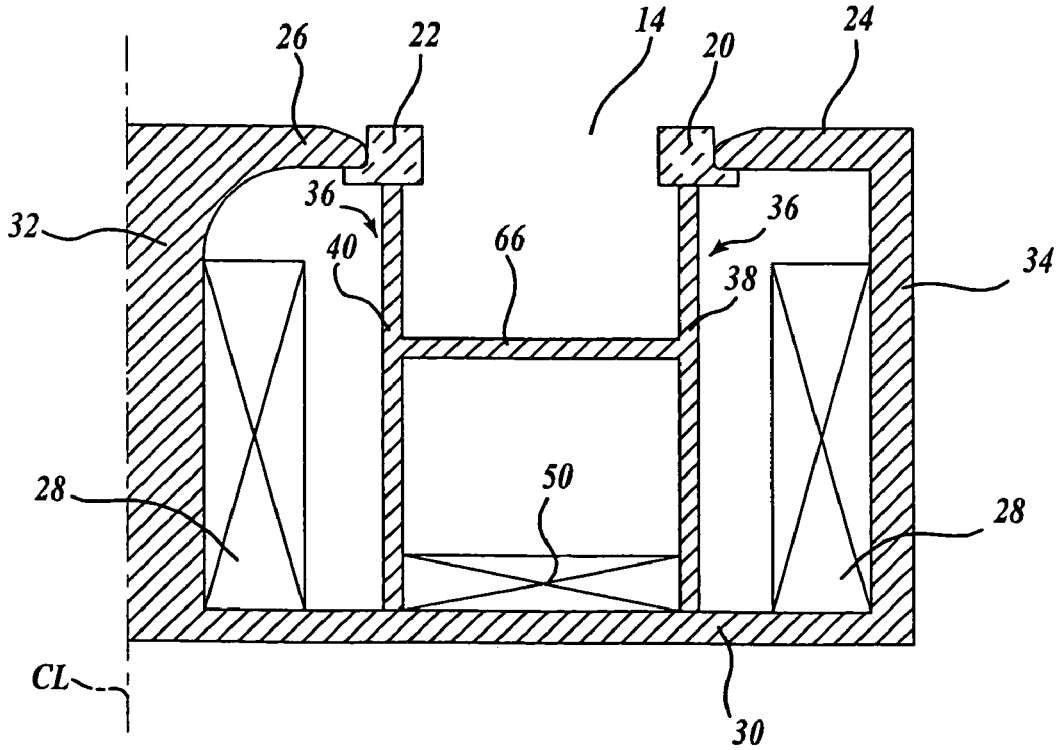

In the design of FIG. 2D, the primary coils 28 are oriented like the primary coils of the embodiment of FIG. 2A, and the secondary coil 50 aligned and located like the secondary coil of the embodiment of FIG. 1. The shunt-anode 36 of the design of FIG. 2D has the connecting disk 66 similar to the designs of FIG. 2B and FIG. 2C, but the outer and inner shells 38, 40 are magnetically coupled to the thruster backplate 30. In the design of FIG. 2D, like the design of FIG. 1, the shells 38 and 40 are electrically isolated from the anode.

In each of the designs of FIGS. 2A–2D, the effect is to create a magnetic field that has generally radially extending magnetic field lines in the exit region 14, generally between the outer and inner poles 24, 26, but the magnetic field transitions abruptly to a generally axially extending field adjacent to the outer and inner shells 38, 40 of the shunt 36. An appropriate gas distribution component would be positioned adjacent to the downstream flange 42 (FIG. 2A) or crosspiece 66 (FIGS. 2B–2D).

Two approaches can be employed to support the anode/shunt and insulator rings. The simplest approach is to mount the anode/shunt of the inner and outer poles separating the mounting ring from the anode with insulating washers. A secondary H-shaped support structure can also be added which ties directly to the inner and outer poles as shown in FIG. 2A.

Figure 3A:
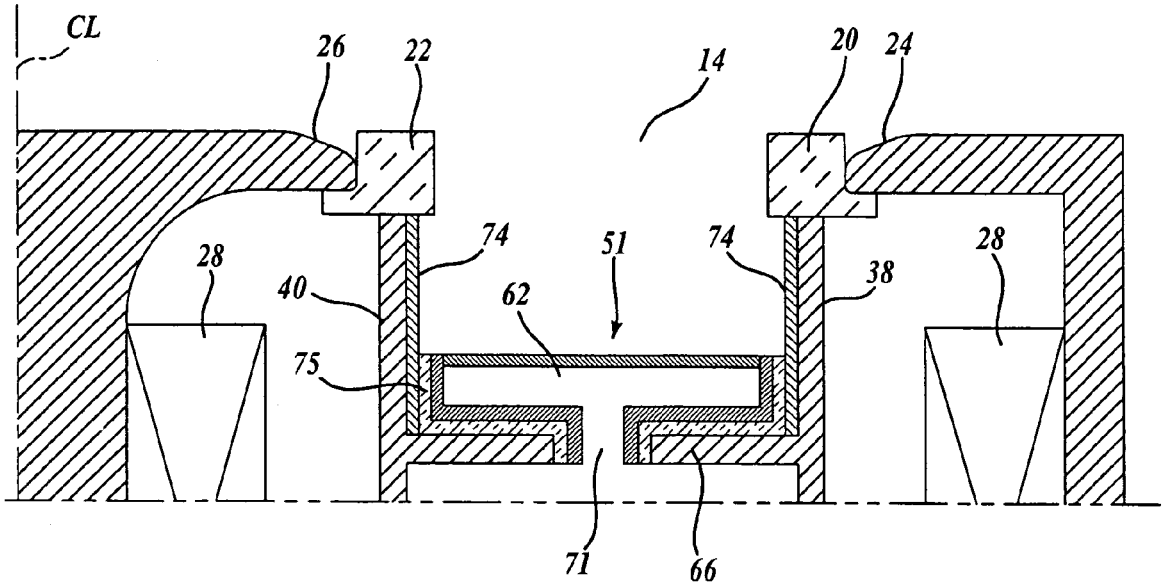
FIGS. 3A–3C are fragmentary sections of modified components of an HET in accordance with the present invention.
Figure 3B:
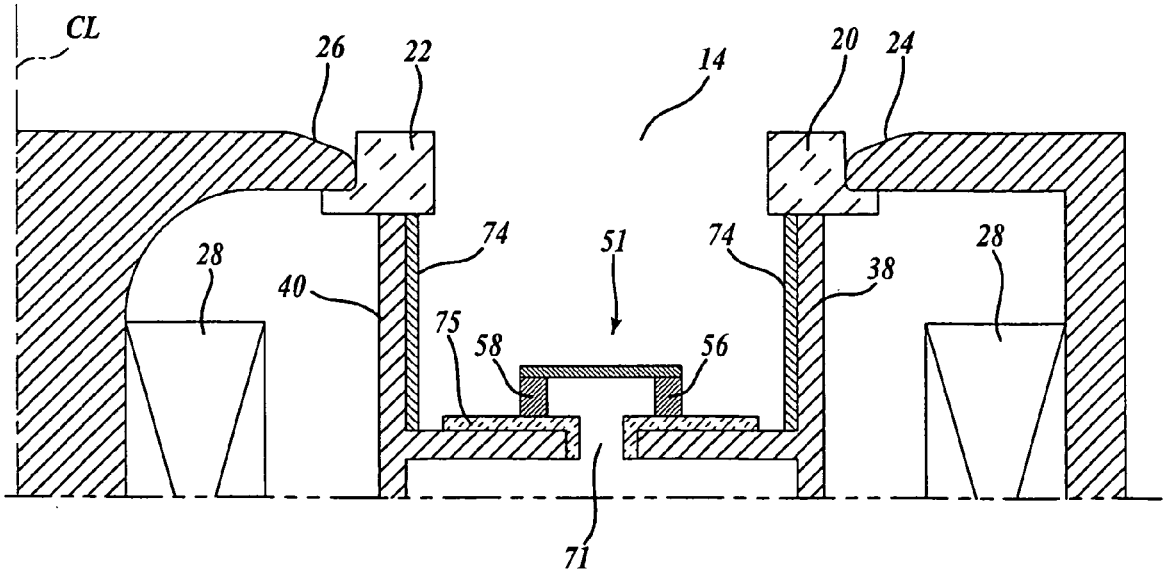
Figure 3C:
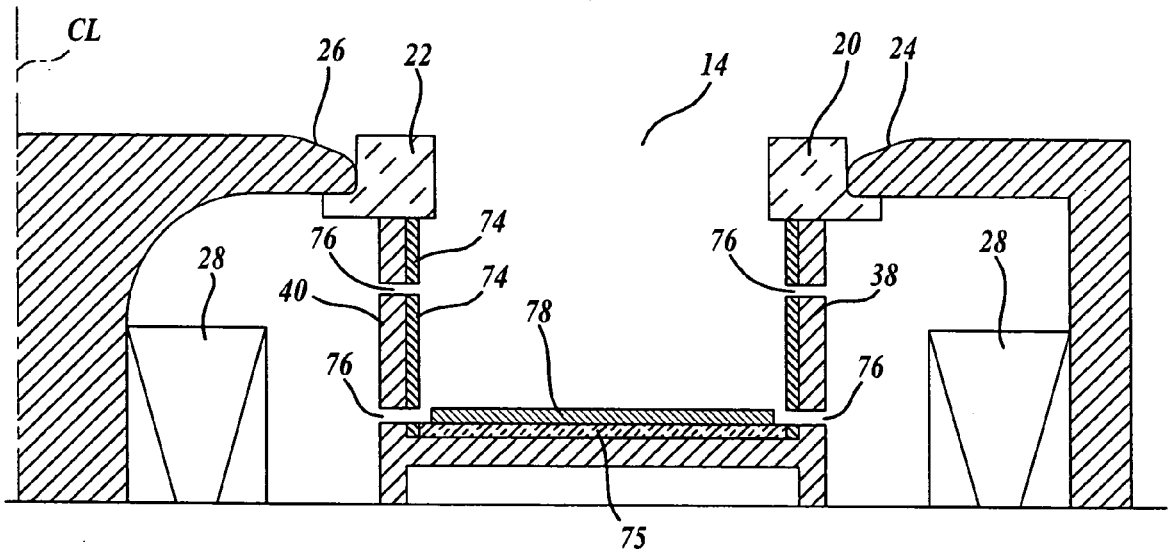

Other configurations are illustrated in FIGS. 3A–3C, including modified gas distribution components. In each of these designs, the outer and inner shells 38, 40 can be magnetically coupled to the backplate of the thruster, like the embodiments of FIGS. 1 and 2D, or be separated from it, like the embodiments of FIGS. 2A–2C. FIG. 3A illustrates the gas distribution component 51 with annular plenum 62 supplied by one or more conduits 71 through the connecting plate 66 between the outer and inner shells 38, 40. The downstream face of the gas distribution component is porous for flow of the ionizable gas therethrough. In addition, the inner surfaces of the shells 38, 40 can be coated or covered with a layer of nonmagnetic material 74.

The design of FIG. 3B is similar to the design of FIG. 3A, except that a gas distribution component 51 of the general type shown in FIG. 1 is used for radial flow of the ionizable gas through the porous rings 56, 58.

In the design of FIG. 3C, gas is infused generally radially through small holes 76 through magnetic shunt shells 38, 40. In each of the designs of FIGS. 3A–3C the shells 38, 40 are not maintained at anode potential. Rather, the anode is formed by conductive portions of the gas distribution component (FIGS. 3A and 3B) or a conductive disk 78 upstream from the exit region 14 (FIG. 3C), and an insulative gasket 75 is provided, similar to the gasket 52 of the embodiment of FIG. 1.

The outer and inner shunt-anode shells 38, 40 can extend downstream within a magnetic pole piece width of the exit plane of the thruster. To achieve the maximum benefit, the distance from the axial tip of each shell to the exit plane should not exceed four magnetic pole widths. If the anode and magnetic shunt are not combined, this requirement can be relaxed. Any other conducting surfaces in the anode or discharge region must be insulated from the anode and floated or biased relative to the thruster body and ground. A sufficient axial distance should be provided between the point or points of introduction of the ionizable gas and the exit plane to provide substantially uniform flow radially across the discharge area of the thruster.

Figure 4:
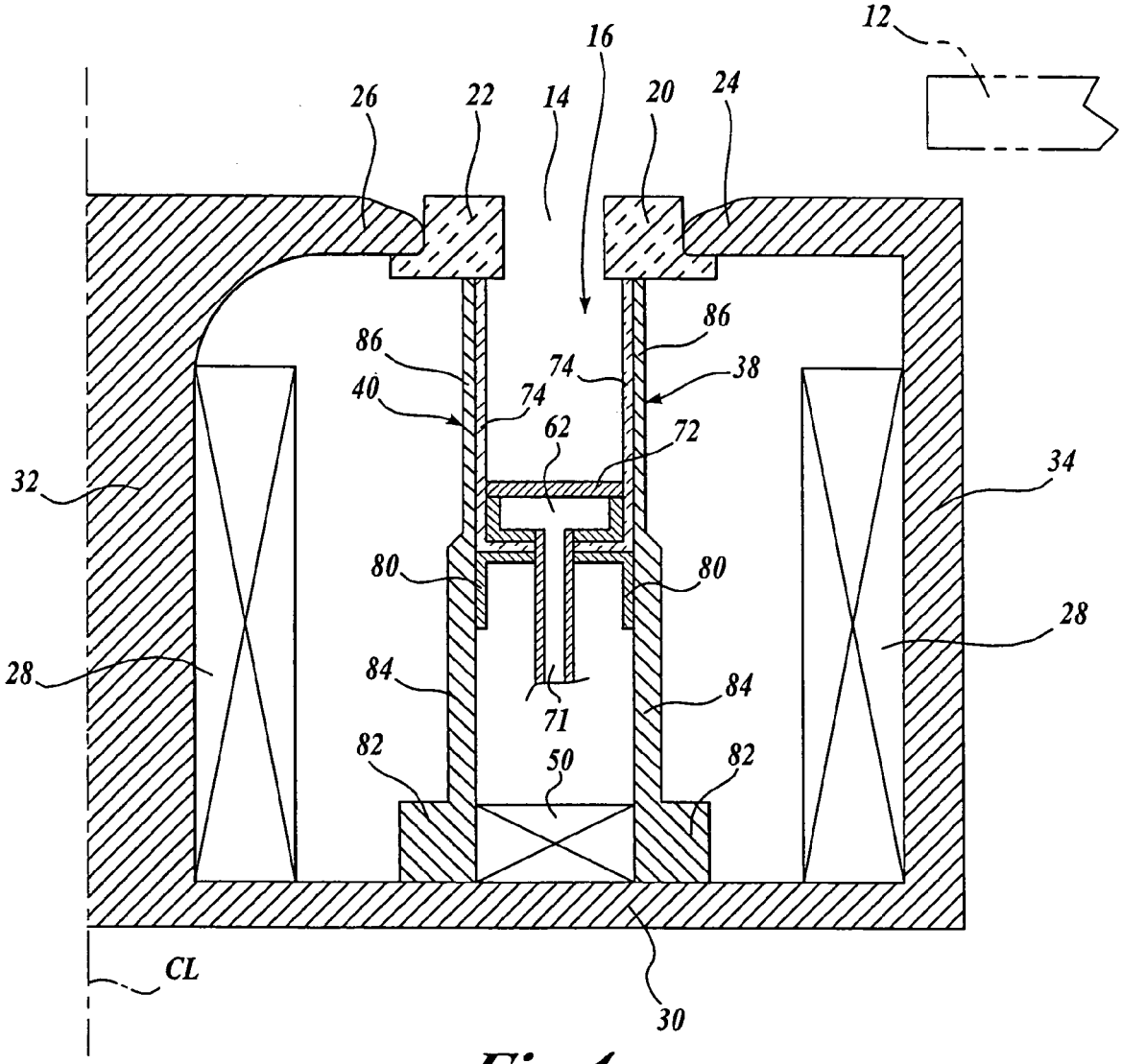
FIG. 4 is a diagrammatic radial section of another embodiment of an HET in accordance with the present invention.

FIG. 4 illustrates an embodiment of the present invention in which the axial magnetic field lines are created in the area downstream of the anode and upstream from the exit area 14, without transversely extending, intermediate flanges, webs, or rings interconnecting the outer shell 38 and inner shell 40. As in the previously described embodiments, the primary magnetic path extends from the outer pole 24, along the outer wall 34, backplate 30, central core 32, and inner pole 26. This path is driven by the coils 28 to produce field lines which extend radially in the exit area 14. The secondary path is defined the outer shell 38 which is magnetically coupled to the backplate 30, and the inner shell 40, also magnetically coupled to the backplate 30. The anode includes a porous plate 72 downstream from the gas plenum 62. Gas from an external source is introduced in the plenum through the conduit 70. The anode can be supported at the upstream end of the discharge channel 16 by flanges or brackets 80, supported on the shells 38 and 40. Such flanges or brackets 80 preferably are electrically isolated from the anode. Similarly, insulating material 74 isolates the anode from the magnetic shells 38 and 40.

In the design of FIG. 4, magnetic material of the outer and inner shells 38 and 40 is concentrated toward the rear of the thruster. For example, a wider portion 82 of each shell is disposed adjacent to the backplate 30, and a thicker segment or portion 84 of each shell extends from the respective portion 82 downstream toward the anode. At a location upstream from the downstream face of the anode, each shell tapers toward a thinner portion or segment 86 that extends to the downstream end, adjacent to the poles 24 and 26, respectively. This construction allows the saturation along the anode sufficient to achieve axially directed field lines in the discharge channel 16 from the anode toward the poles 24 and 26 where the field lines are substantially radial.

Other than the primary benefit of increased efficiency, there are several other benefits of this invention. Thruster lifetimes which are of critical importance to spacecraft users are predicted based on initial testing to exceed 10,000 hours. The significant lifetime increase is achieved by locating the ion accelerating region of the discharge downstream of the exit plane of the thruster. The relocation of the accelerating region external to the thruster is accomplished by steepening the axial gradient of magnetic field strength with the magnetic shunt and secondary flux coil. If the discharge is located external to the thruster, the operating power density can be significantly increased without adversely effecting life. Increasing the operating power density significantly reduces thruster masses and envelopes as well as allows a given thruster to operate at peak efficiencies over a much larger range of powers and voltages.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A Hall effect ion accelerator having an annular gas discharge channel including an exit end portion, discharge of gas through the exit end portion defining a downstream direction, said accelerator comprising:

an inner magnetic pole located at the inside of and encircled by the annular gas discharge area adjacent to the exit end portion;

an outer magnetic pole located at the outside of and encircling the annular gas discharge area adjacent to the exit end portion, the inner and outer magnetic poles being magnetically coupled by a first magnetic path;

a first magnetic field source associated with the first magnetic path for producing a generally radially extending magnetic field between the inner pole and the outer pole at the exit end portion of the gas discharge channel;

an anode located upstream of the exit end portion of the gas discharge channel;

a gas source for supplying an ionizable gas to the gas discharge channel for flow in a downstream direction toward the exit end portion;

an electron source for supplying free electrons for introduction through the exit end portion of the gas discharge channel in a generally upstream direction;

an electric field source for producing an electric field extending from the anode in a downstream direction toward the exit end portion of the gas discharge channel, interaction between the ionizable gas from the gas source and free electrons from the electron source providing ions accelerated in a downstream direction by the electric field;

a magnetic shunt of H-shape including an outer shell of magnetic material having a downstream end adjacent to the innermost part of the outer pole and extending upstream therefrom along an outer portion of the gas discharge channel, an inner shell of magnetic material having a downstream end adjacent to the outermost part of the inner pole and extending upstream therefrom along an inner portion of the gas discharge channel and a web located intermediate the upstream and downstream ends of the inner and outer shells, the web having portions extending inward from the outer shell and outward from the inner shell so as to magnetically couple the inner and outer shells behind the anode to define a second magnetic path; and a second magnetic field source associated with the second magnetic path and generating magnetic flux there along sufficient to generate magnetic field lines extending generally axially in the gas discharge channel from a location adjacent to the anode and downstream toward the exit end portion of the gas discharge channel to enhance election mobility in an area between the anode and the exit end portion of the gas discharge channel.

2. The accelerator defined in claim 1, in which the magnetic field in the gas discharge channel induced by the first magnetic field source and second magnetic field source transitions abruptly from a generally radial direction at the exit end portion to a generally axial direction upstream from the exit end portion.

3. The accelerator defined in claim 1, in which the magnetic material of the second path is concentrated in an area upstream of the anode.

4. The accelerator defined in claim 1, in which the web of the magnetic shunt includes a first long annular flange of magnetic material that extends outward from the inner shell with its outer end close to, but spaced from, the outer shell and a second long annular flange of magnetic material that extends inward from the outer shell with its inner end close to, but spaced from, the inner shell.

5. The accelerator defined in claim 4, in which the first and second flanges overlap and are closely spaced for magnetic coupling.

6. The accelerator defined in claim 1, in which the inner and outer magnetic poles have upstream ends magnetically coupled by a first thruster backplate, and the inner and outer shells of the H-shaped shunt have upstream ends connected by a separate backplate, spaced in a downstream direction from the first thruster backplate, such that the first and second backplates are not magnetically coupled.

7. The accelerator defined in claim 1, in which the web portions extending inward from the outer shell and outward from the inner shell form a continuous intermediate annular plate extending between the inner and outer shells.

8. The accelerator defined in claim 1, in which the inner and outer poles have upstream portions magnetically coupled by a thruster backplate, the shunt being constructed and arranged to be electrically insulated from the thruster backplate and to function as the anode of the accelerator.

9. The accelerator defined in claim 1, in which the inner and outer poles have upstream portions magnetically coupled by a thruster backplate, the inner and outer shells having respective upstream ends magnetically coupled by the thruster backplate.

10. The accelerator defined in claim 1, in which the second magnetic field source is located between the inner and outer shells at a location upstream of the web.

* * * * *

UNITED STATES PATENT AND TRADEMARK OFFICE

CERTIFICATE OF CORRECTION

PATENT NO. : 7,164,227 B2
APPLICATION NO. : 11/233401
DATED : January 16, 2007
INVENTOR(S) : K.H. de Grys It is certified that error appears in the above-identified patent and that said Letters Patent is hereby corrected as shown below:

| COLUMN | LINE | ERROR |
|---|---|---|
| 4 | 29 | "outer shell **36**" should read --outer shell **38**-- |
| 8 (Claim 1, | 8 Line 47) | "there along" should read --therealong-- |

Signed and Sealed this

Tenth Day of July, 2007

JON W. DUDAS
*Director of the United States Patent and Trademark Office*